US011330891B2

(12) United States Patent
Foley

(10) Patent No.: US 11,330,891 B2
(45) Date of Patent: May 17, 2022

(54) CUT CREASE CREATOR MAKEUP TOOLS, KITS AND METHODS

(71) Applicant: BEAUTIFOLES LLC

(72) Inventor: Brittney Foley, Kings Park, NY (US)

(73) Assignee: Beautifoles LLC, Kings Park, NY (US)

( * ) Notice: Subject to any disclaimer, the term of this patent is extended or adjusted under 35 U.S.C. 154(b) by 466 days.

(21) Appl. No.: 15/806,664

(22) Filed: Nov. 8, 2017

(65) Prior Publication Data

US 2018/0125203 A1 May 10, 2018

Related U.S. Application Data

(60) Provisional application No. 62/419,005, filed on Nov. 8, 2016.

(51) Int. Cl.
*A45D 40/30* (2006.01)
*A45D 40/26* (2006.01)

(52) U.S. Cl.
CPC ..... *A45D 40/30* (2013.01); *A45D 40/26* (2013.01); *A45D 2200/25* (2013.01)

(58) Field of Classification Search
CPC ..... A45D 40/20; A45D 40/30; A45D 40/002; A45D 2040/201; A45D 2034/002
USPC ..... 132/319
See application file for complete search history.

(56) References Cited

U.S. PATENT DOCUMENTS 1,907,476 A * 5/1933 Ballard ..... A45D 40/30 132/216
4,807,650 A * 2/1989 Bliss ..... A45D 40/30 132/319
4,936,325 A * 6/1990 Davis ..... A45D 40/30 132/216
6,199,560 B1 * 3/2001 North ..... A45D 44/12 132/319
6,640,814 B1 * 11/2003 Burke ..... A45D 2/48 132/319
D532,929 S * 11/2006 Weltmann ..... D28/7
9,635,924 B1 * 5/2017 Herrera ..... A45D 40/30
2004/0255971 A1 * 12/2004 Houghton ..... A45D 40/30 132/319
2009/0183747 A1 * 7/2009 Salicunaj ..... A45D 40/30 132/200

(Continued)

FOREIGN PATENT DOCUMENTS

FR 1060527 A * 4/1954 ..... A45D 40/30

*Primary Examiner* — Tatiana L Nobrega
*Assistant Examiner* — Sarah Woodhouse
(74) *Attorney, Agent, or Firm* — Carter, DeLuca & Farrell LLP

(57) ABSTRACT

A kit for applying makeup includes a tool having a handle and an eyecup attached to the handle. A plurality of guide attachments are configured to releasably engage the eyecup, each defining a different contoured edge. A method of applying makeup includes selecting a guide attachment based upon a contoured edge of the guide attachment, engaging the guide attachment with an eyecup of a tool, positioning the tool relative to a first eye such that the contoured edge of the guide attachment is positioned adjacent to a crease of an eye socket between a top of an eyelid and a bottom of a brow bone of the first eye, and applying makeup to the first eye following the contoured edge of the guide attachment such that the makeup is applied to the first eye as an arc shaped similar to the contoured edge of the guide attachment.

9 Claims, 8 Drawing Sheets

(56) References Cited

U.S. PATENT DOCUMENTS

| | | | | |
|---|---|---|---|---|
| 2009/0194126 | A1* | 8/2009 | Cassese | A45D 2/48<br>132/216 |
| 2016/0286935 | A1* | 10/2016 | Macias-Abu | A45D 40/30 |
| 2017/0049216 | A1* | 2/2017 | Rhoades | A45D 40/30 |
| 2017/0086565 | A1* | 3/2017 | Butcher | A45D 40/30 |

* cited by examiner

CUT CREASE CREATOR MAKEUP TOOLS, KITS AND METHODS

CROSS-REFERENCE TO RELATED APPLICATIONS

This application claims the benefit of, and priority to, U.S. Provisional Patent Application No. 62/419,005, entitled "CUT CREASE CREATOR MAKEUP TOOL AND METHOD OF USE THEREOF" and filed on Nov. 8, 2016, the entire contents of which are hereby incorporated herein by reference.

BACKGROUND

Technical Field

The present disclosure relates to makeup tools, makeup kits, and makeup application. More specifically, the present disclosure relates to makeup tools and kits configured for use during the application of eye makeup to aid a user in contouring their eyelids, and to methods regarding the same.

Background of Related Art

Makeup contouring is a popular technique utilized to create distinct areas of shading and lightness in order to create depth, dimension, curvature, and/or accentuate certain portions of a person's face. However, contouring may be a difficult technique to achieve as it often requires a steady hand and the proper placement of makeup to create the desired contouring effect. Contouring may prove especially difficult when applying eye makeup to the socket line of the eyelid between the top of the eyelid and the bottom of the brow bone. Such application requires precision in the manual application of eye makeup in a desired shape within the crease line of the eye socket.

It would therefore be useful to have a tool or kit that makes it easier to achieve this contouring makeup technique and a method of use of the same for contouring. However, despite the fact that the prior art discloses many different types of devices for make-up application and methods for contouring, none of the prior art devices, so far as is known, provide a tool or method that facilitates contouring in a simple, easy-to-use, and effective manner.

SUMMARY

The present disclosure provides makeup tools, kits, and methods that facilitate the application of eye makeup for eyelid contouring. More specifically, the present disclosure provides makeup tools and kits that serve as guides between the top of the eyelid and the bottom of the brow bone during application of eye makeup, to thereby define an suitable arc shape in the crease of the eye socket to facilitate contouring thereof. Methods of applying eye makeup facilitating contouring are also provided. These and other aspects and features of the present disclosure are detailed below. To the extent consistent, any of the aspects and features described herein may be used in conjunction with any or all of the other aspects and features described herein.

Provided in accordance with aspects of the present disclosure is a kit facilitating application of makeup. The kit includes a tool having a handle and an eyecup disposed at one end of the handle. A plurality of guide attachments is configured to releasably engage the eyecup. Each of the guide attachments defines a different contoured edge to facilitate applying makeup in a different arc shape.

In an aspect of the present disclosure, the handle includes at least one ergonomic feature to facilitate grasping the handle. The ergonomic feature may include, for example, a depression and/or a ridge.

In another aspect of the present disclosure, the eyecup defines a curved configuration to generally conform to an eye.

In yet another aspect of the present disclosure, each of the guide attachments is reversible.

In still another aspect of the present disclosure, one side of each of the guide attachments is configured to facilitate application of makeup to one eye, and the other side of each of the guide attachments is configured to facilitate application of makeup to an opposite eye.

In still yet another aspect of the preset disclosure, each of the guide attachments includes indicia indicating different sides thereof. Additionally or alternatively, each of the guide attachments may include indicia indicating a configuration of the contoured edge thereof.

In another aspect of the present disclosure, each of the guide attachments is one of a guide attachment pair. One guide attachment in each guide attachment pair is configured to facilitate application of makeup to a left eye, and the other guide attachment in each guide attachment pair is configured to facilitate application of makeup to a right eye. The guide attachments in each guide attachment pair define mirror-image configurations of one another.

In yet another aspect of the present disclosure, the contoured edge of at least one of the plurality of guide attachments is a round-shaped edge, a winged-shaped edge, an elongated arc-shaped edge, or an almond-shaped edge.

In another aspect of the present disclosure, each of the guide attachments is a guide sleeve configured to receive the eyecup therein to releasably engage the guide sleeve about the eyecup. Alternatively, each of the guide attachments is a guide panel defining a recess configured to at least partially receive the eyecup therein to releasably engage the guide panel on the eyecup.

In yet another aspect of the present disclosure, the makeup tool includes an offset disposed between and interconnecting the handle with the eyecup such that the eyecup is offset relative to the handle.

A method of applying makeup provided in accordance with the present disclosure includes selecting a guide attachment based upon a contoured edge of the guide attachment, engaging the guide attachment with an eyecup of a tool, positioning the tool relative to a first eye such that the contoured edge of the guide attachment is positioned adjacent to a crease of an eye socket between a top of an eyelid and a bottom of a brow bone of the first eye, and applying makeup to the first eye following the contoured edge of the guide attachment such that the makeup is applied to the first eye as an arc shaped similar to the contoured edge of the guide attachment.

In an aspect of the present disclosure, engaging the guide attachment with the eyecup of the tool includes engaging the guide attachment in an orientation according to whether the first eye is a left eye or a right eye. In such aspects, the method may further include reversing the orientation of the guide attachment, and positioning the tool and applying makeup to the second eye similarly as with the first eye, detailed above.

In another aspect of the present disclosure, selecting the guide attachment further includes selecting the guide attachment based upon whether the first eye is a left eye or a right eye. In such aspects, the method may further include removing the guide attachment from the eyecup, engaging a mirror-image guide attachment to the eyecup, and positioning the tool and applying makeup to the second eye similarly as with the first eye, detailed above.

BRIEF DESCRIPTION OF THE DRAWINGS

Various aspects and features of the present disclosure are described hereinbelow with reference to the drawings wherein like numerals designate identical or corresponding elements in each of the several views and.

DETAILED DESCRIPTION

Figure 1:
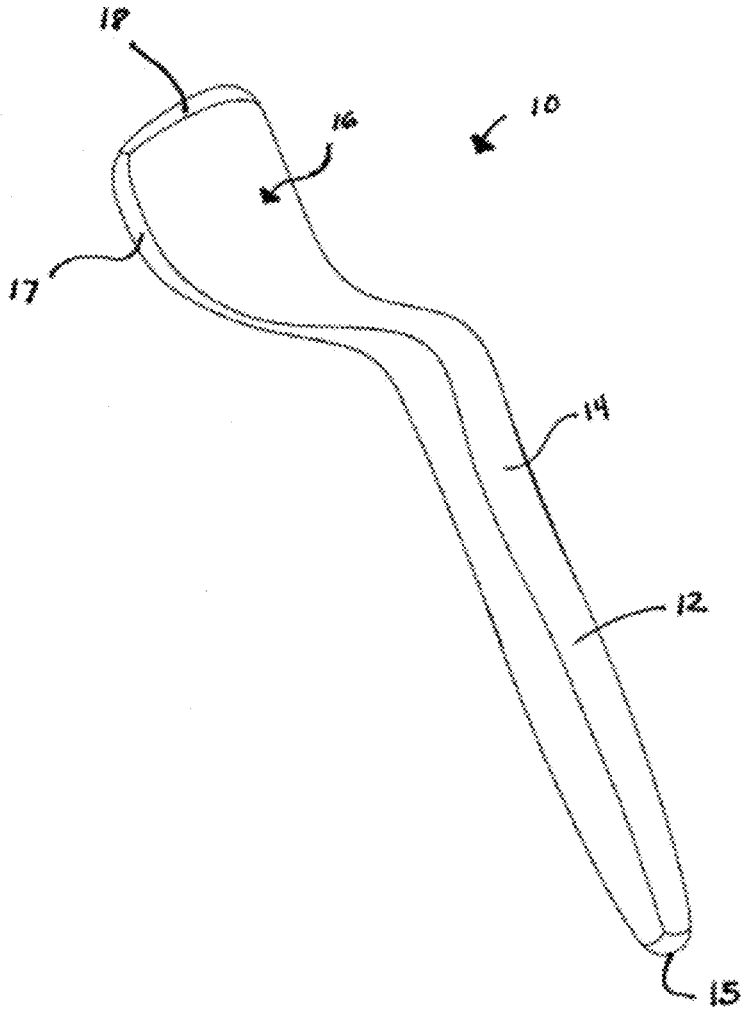
FIG. 1 is a side, perspective view of a cut crease creator makeup tool provided in accordance with the present disclosure.
Figure 2:
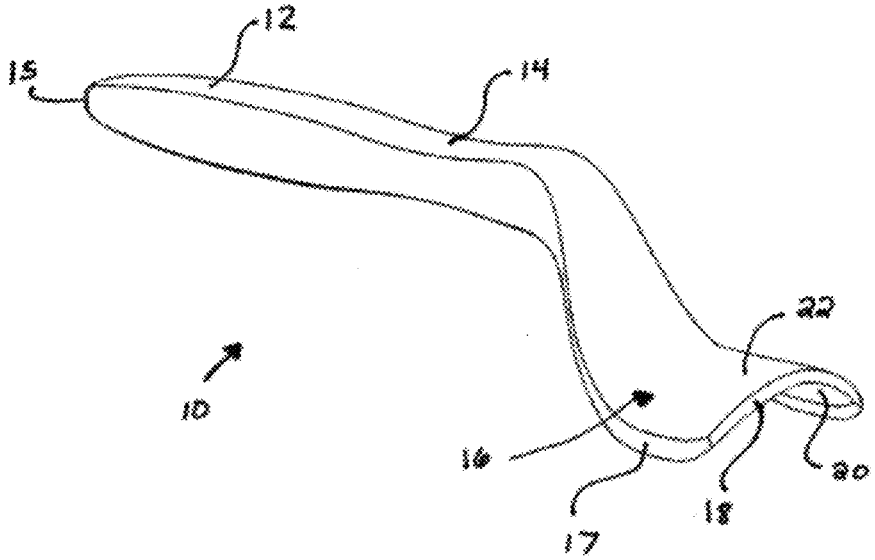
FIG. 2 is a front, top perspective view of the tool of FIG. 1.

Referring to FIGS. 1 and 2, a first embodiment of a cut crease creator makeup tool provided in accordance with the present disclosure is generally illustrated by reference number 10. Tool 10 includes a handle 12 which is adapted to be grasped by a user and, to this end, may include any suitable ergonomic features facilitating comfortable grasping by the user. For example, to facilitate ergonomic grasping and manipulation of tool 10, handle 12 may define a thumb depression 14 formed on the front and/or rear sides thereof. Thumb depression 14, more specifically, has a width that is wider than the surrounding portions of handle 12 to aid a user in grasping and stabilizing tool 10 in a desired position. The thumb depression 14 also provides added comfort, an improved grip, and allows for self-use of tool 10 as well as use of tool 10 on someone else. Handle 12 may be formed from a plastic material, silicone, rubber, or any other suitable material that is easily cleaned and visually pleasing. Handle 12 may exhibit any color or variety of colors, patterns, graphics, or the like, and may be transparent or opaque.

Continuing with reference to FIGS. 1 and 2, handle 12 defines a first end 15 of tool 10, while an eyecup 16 extends from the opposite end of handle 12 to define an upper edge 18 at the second, opposite end of tool 10 (opposite the first end 15 thereof) and opposing lateral side edges 17 which interconnect upper edge 18 with handle 12 on either side of tool 10. With momentary reference to FIGS. 6A-6C, eyecup 16 is configured to be placed over an eyelid 102 of a user 100, with its upper edge 18 disposed in a desired location adjacent to the crease 104 of the eye socket between the top of the eyelid 102 and the bottom of the brow bone. Once at a placed in desired location, the upper edge 18 of eyecup 16 acts as a guide or template for the user to utilize when applying makeup to create an arc-shaped makeup crease on the eyelid 102.

Referring again to FIGS. 1 and 2, upper edge 18 of eyecup 16 has a rounded contour, so that it may be used to apply eye makeup in an arc-shape that generally conforms to the user's eyelid. Additionally, opposing lateral side edges 17 of eyecup 16 curve inwardly towards the front face of tool 10. As a result, eyecup 16 has a concave front surface 20 and a convex rear surface 22. The concave front surface 20 permits the eyecup 16 to more comfortably rest against the user's eyelid. However, it is appreciated that the precise shape and contours of handle 12 and eyecup 16 of tool 10 may vary, depending upon a particular purpose.

Figure 3:
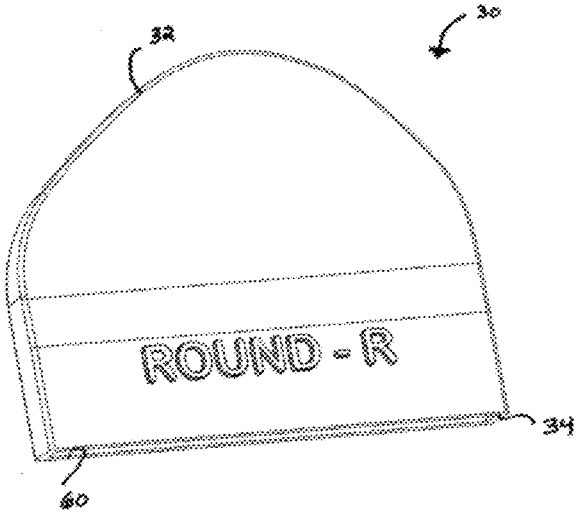
FIG. 3 is a front, perspective view of a round guide tip sleeve configured for use with the tool of FIG. 1.
Figure 4:
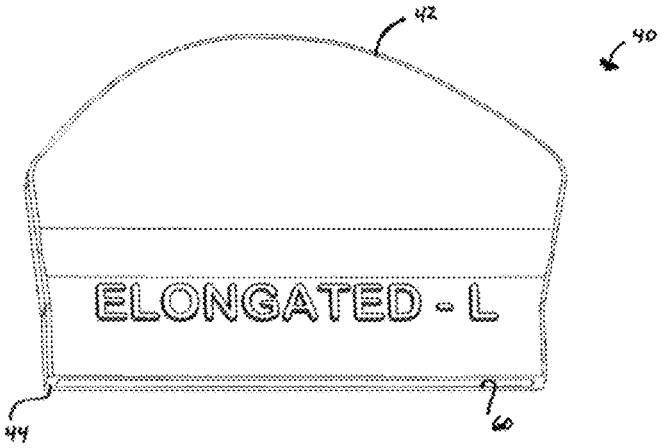
FIG. 4 is a front, perspective view of an elongated arc guide tip sleeve configured for use with the tool of FIG. 1.
Figure 5:
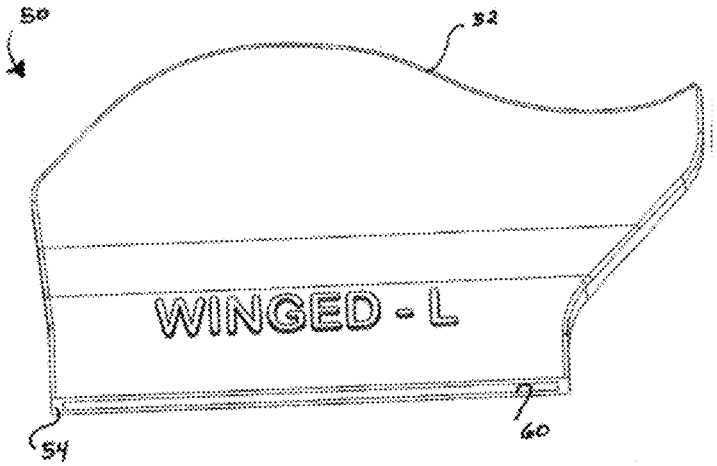
FIG. 5 is a front, perspective view of a winged guide tip sleeve configured for use with the tool of FIG. 1.

Referring to FIGS. 3-5, in conjunction with FIGS. 1 and 2, in addition or as an alternative to directly using eyecup 16 to facilitate application of makeup, eyecup 16 may also serve as a connector to enable engagement of various different guide top sleeves or attachments 30, 40, 50 therewith to enable the guide top sleeves 30, 40, 50 to facilitate application of makeup. More specifically, eyecup 16 is configured to receive sleeves 30, 40 and 50 by sliding over upper edge 18 of eyecup 16 and into place substantially surrounding eyecup 16 and retained thereon via friction fit. Sleeves 30, 40, and 50 define upper edges 32, 42, and 52, respectively, with different contours to allow makeup to be applied in various different arc shapes.

A rounded-shape guide tip sleeve 30 is illustrated in FIG. 3, an elongated arc-shape guide tip sleeve 40 is illustrated in FIG. 4, and a winged-shape guide tip sleeve 50 is illustrated in FIG. 5. However, these guide tip sleeves 30, 40 and 50 are merely examples, as sleeves of any suitable configuration may be provided for use with tool 10. Regardless of the particular configuration of the upper edge 32, 42, and 52 of the respective sleeve 30, 40 and 50, each guide tip sleeve 30, 40, and 50 defines an inner pocket 60 formed therein. Inner pockets 60 define open lower ends configured to receive eyecup 16 of tool 10 to enable sleeves 30, 40 and 50 to be positioned about eyecup 16 with eyecup 16 received within the inner pocket 60 thereof. Other ways of attaching sleeves 30, 40, and 50 to eyecup 16 are contemplated such as for example, by adhesives, Velcro, a snap fit configuration, a sliding insert configuration and via any other suitable attachment means.

Guide tip sleeves 30, 40, and 50 may define a generally flat configuration at-rest and may be made of a flexible material, for example, a flexible plastic, silicon or rubber, or the like, so that they may be bent, manipulated, or otherwise flexed to facilitate fitting of the guide tip sleeves 30, 40, 50 over the curved eyecup 16. Further, the flexibility of guide tip sleeves 30, 40, and 50 enable reversible use thereof. That is, guide tip sleeves 30, 40, and 50 are reversible such that one side is adapted for use with the right eye, and the other side is adapted for use with the left eye. Particularly, the contours of upper edges 32, 42, and 52 on the front faces of sleeves 30, 40 and 50 respectively, are mirror images of the contours of upper edges 32, 42, and 52, respectively, on the rear faces of sleeves 30, 40 and 50 respectively.

Indicia molded into sleeves 30, 40 and 50 during formation thereof, printed thereon, or otherwise provided, enables a user to readily identify which side of the sleeve 30, 40 and 50 is configured for which eye. Such indicia may include, for example, the letter "R" for the right eye and the letter "L" for the left eye, although other suitable indicia are also contemplated. Additional indicia may also be provided, such as, for example, identifying words, e.g., "ROUND," "ELONGATED," and "WINGED," to enable a user to readily identify the contours of upper edges 32, 42, and 52 of the different sleeves 30, 40 and 50, respectively.

Figure 6A:
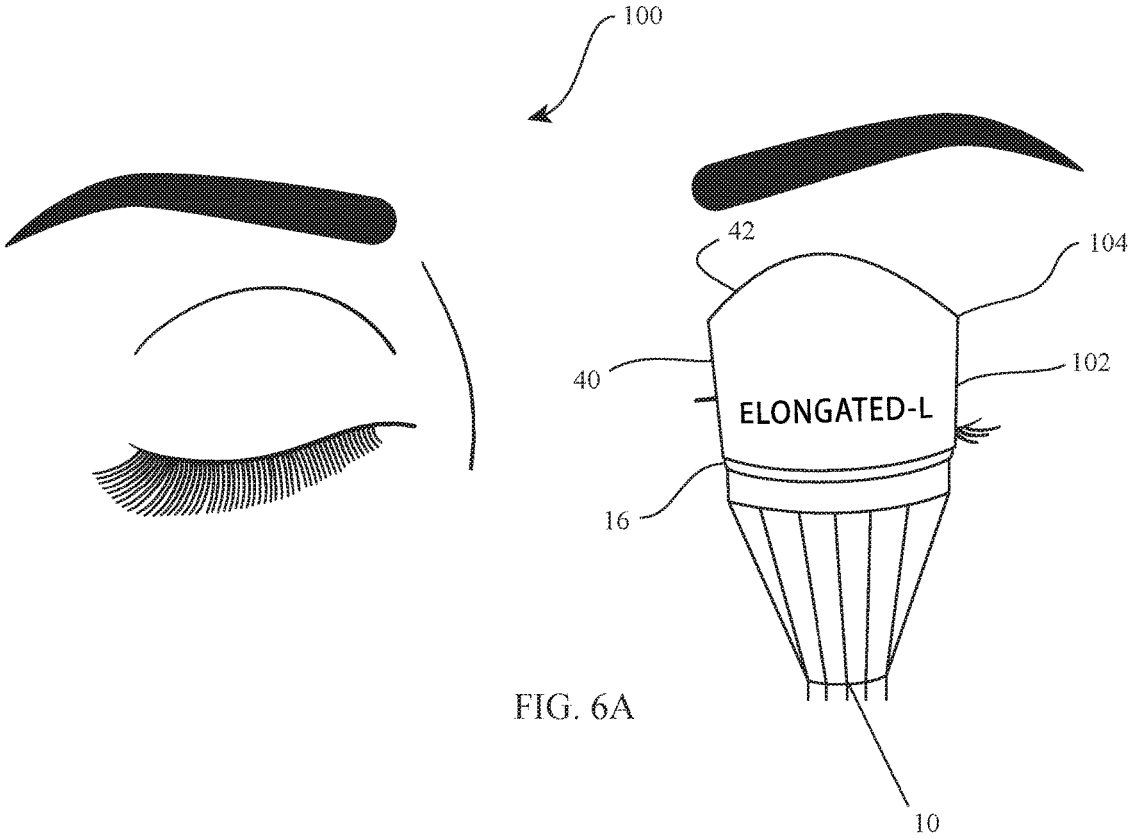
FIGS. 6A-6C illustrate use of the tool of FIG. 1 and the elongated arc guide tip sleeve of FIG. 4 to facilitate contouring of an eyelid.
Figure 6B:
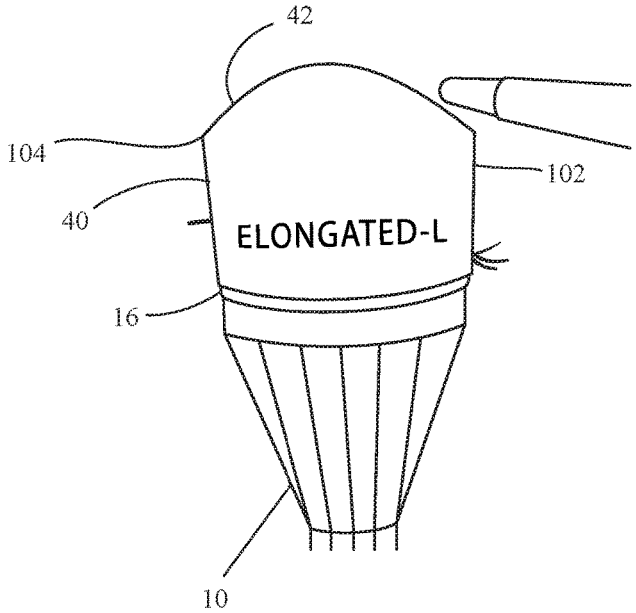
Figure 6C:
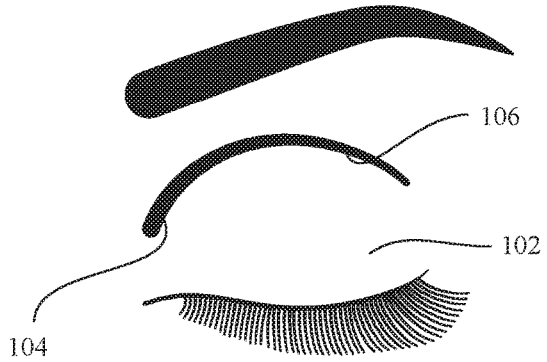
Figure 7A:
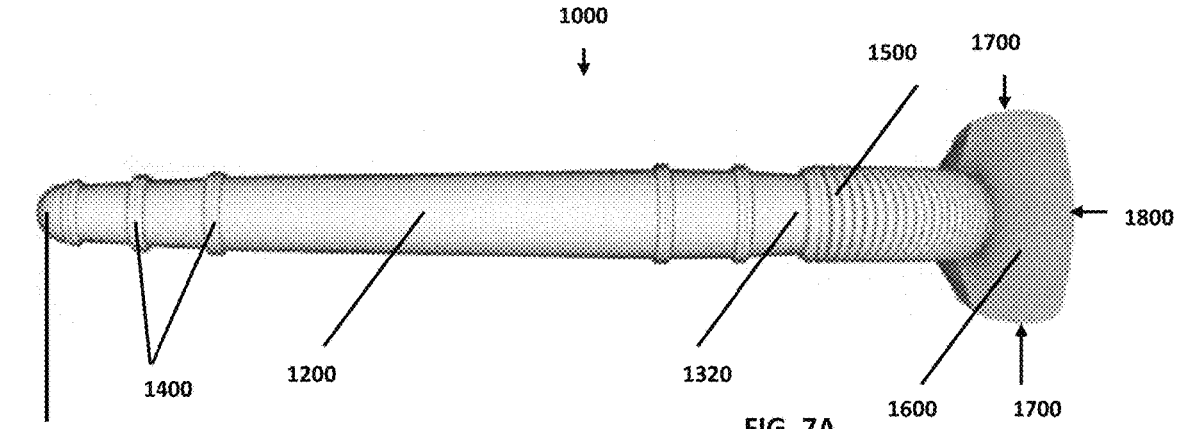
FIG. 7A is a bottom view of a another cut crease creator makeup tool provided in accordance with the present disclosure.
Figure 7B:
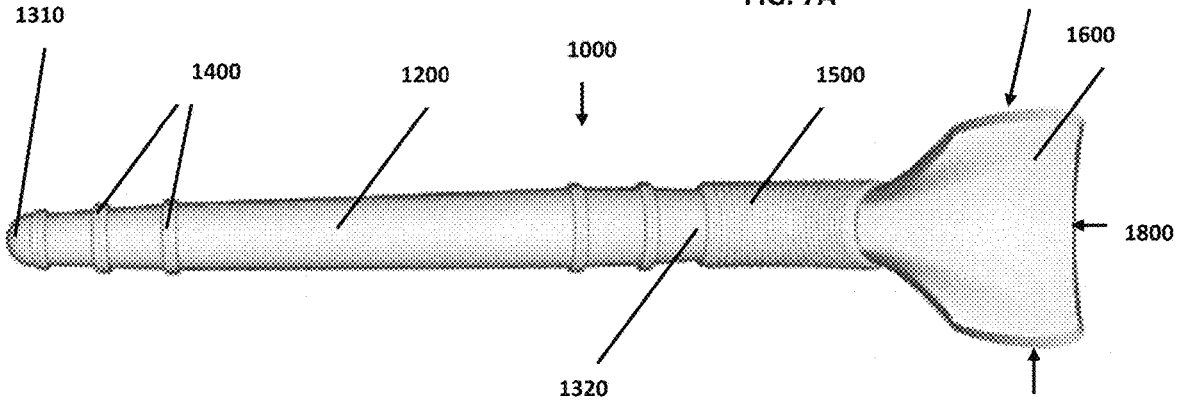
FIG. 7B is a top view of the tool of FIG. 7A.
Figure 7C:
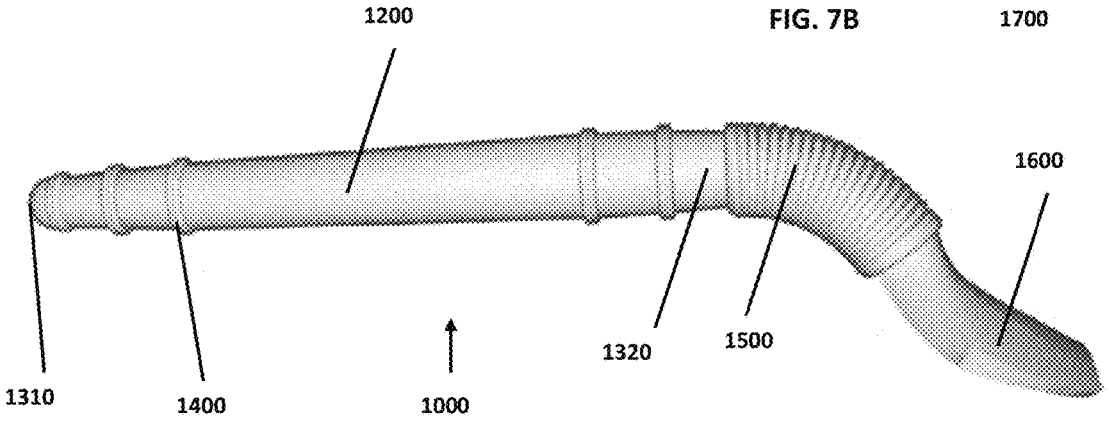
FIG. 7C is a side view of the tool of FIG. 7A.
Figures 7D, 7E:
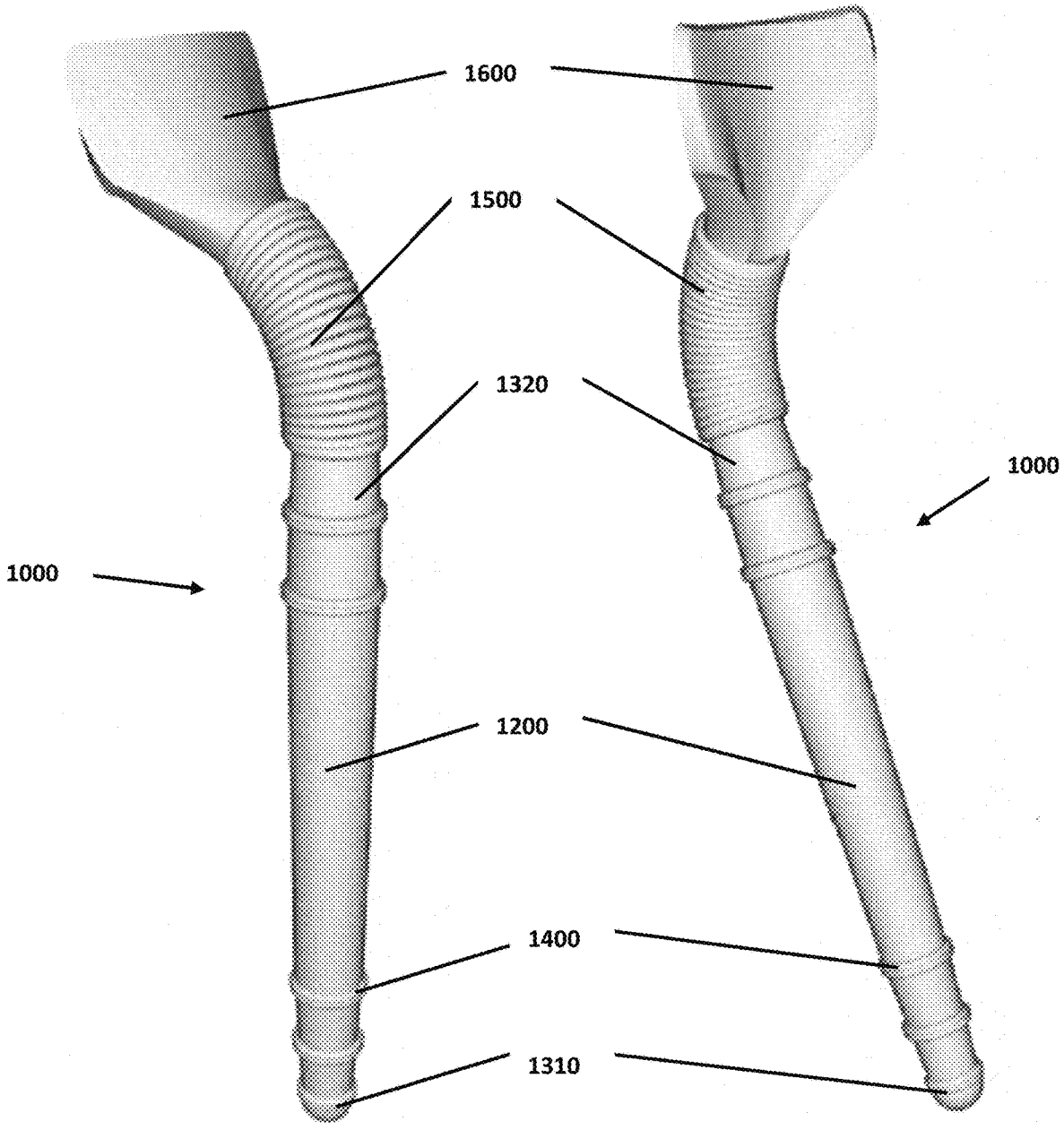
FIGS. 7D and 7E are left and right perspective views of the tool of FIG. 7A.
Figure 8A:
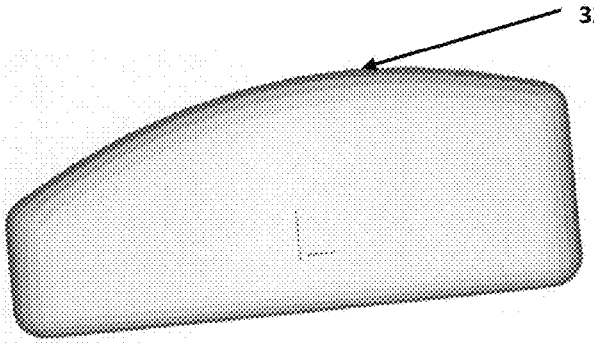
FIGS. 8A-8E are various views of an almond guide tip attachment configured for use with the tool of FIG. 7A.
Figure 8B:
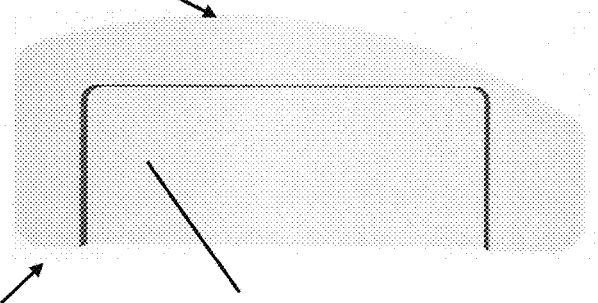
Figure 8C:
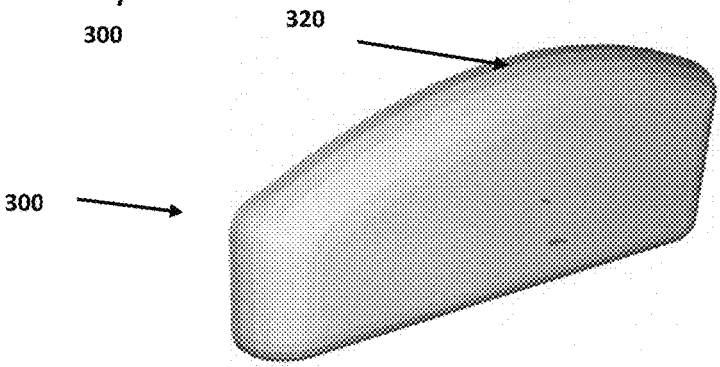
Figure 8D:
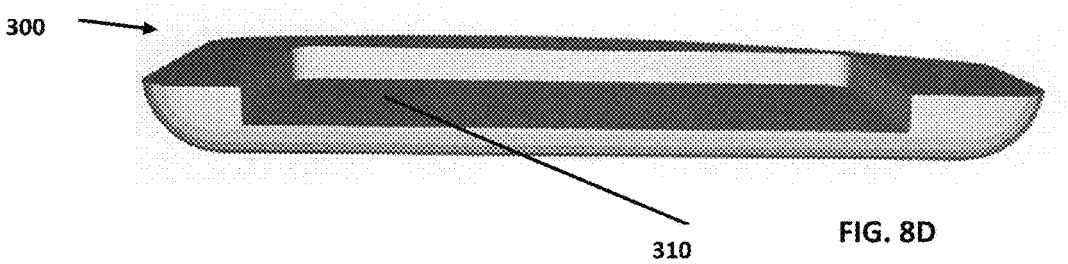
Figure 8E:
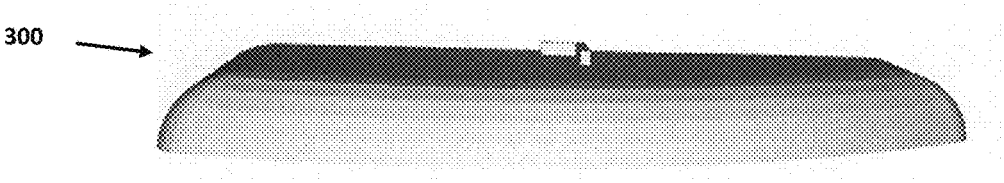
Figure 9A:
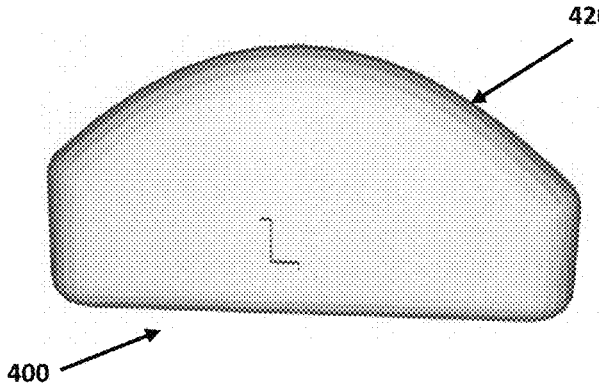
FIGS. 9A-9D are various views of a rounded guide tip attachment configured for use with the tool of FIG. 7A.
Figure 9B:
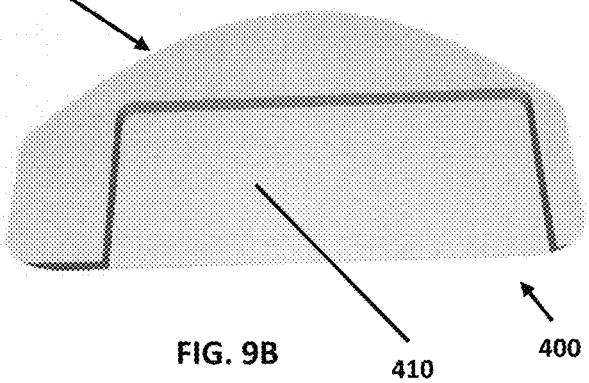
Figure 9C:
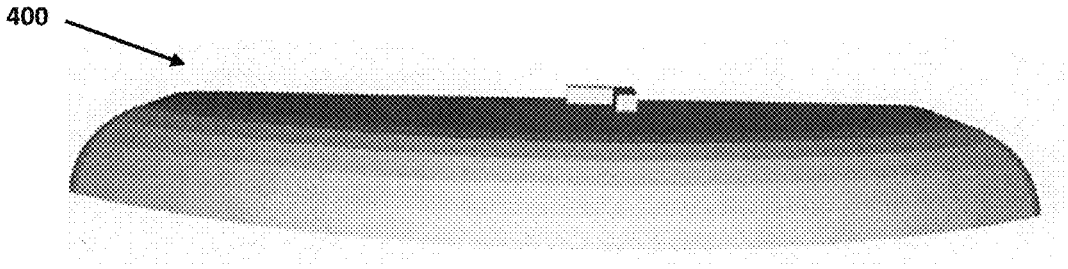
Figure 9D:
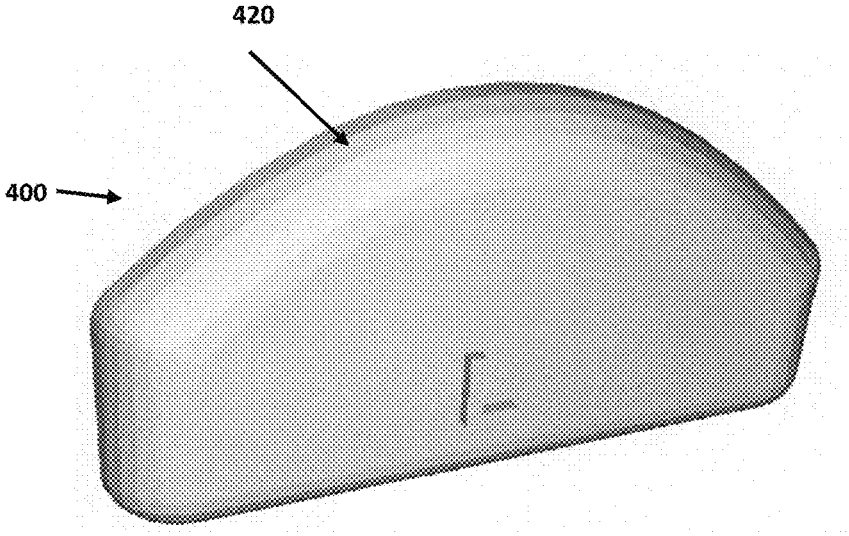
Figure 10A:
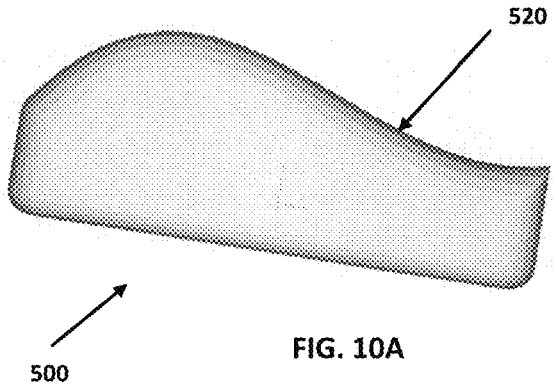
FIGS. 10A-10D are various views of a winged guide tip attachment configured for use with the tool of FIG. 7A.
Figure 10B:
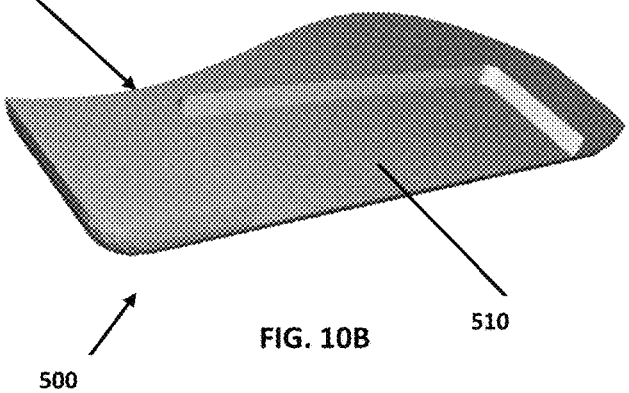
Figure 10C:
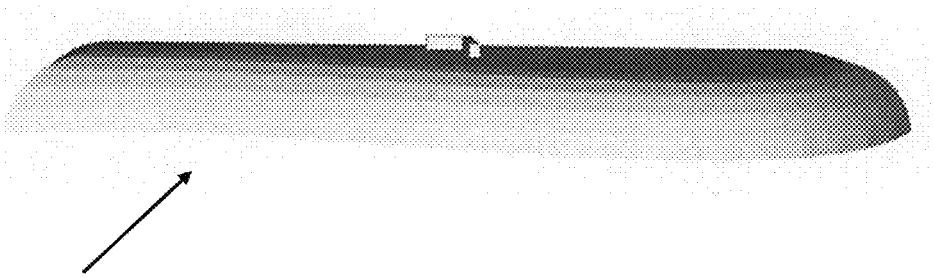
Figure 10D:
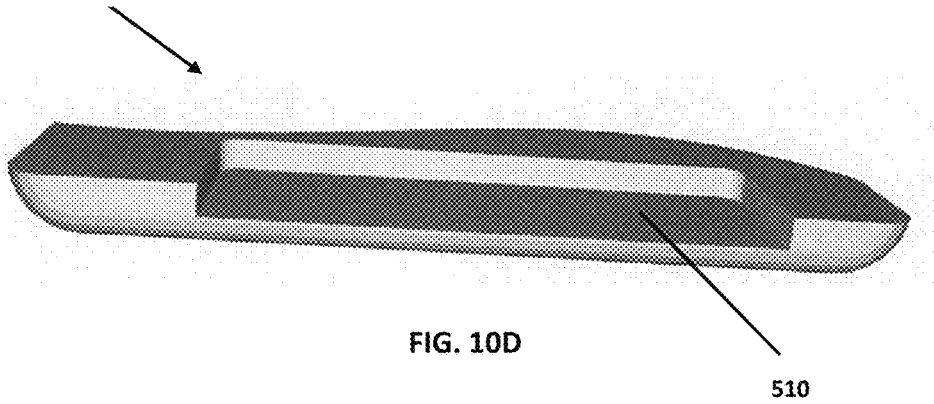

With reference to FIGS. 6A-6C, in conjunction with FIGS. 1-5, to utilize tool 10 with one of the guide tip sleeves 30, 40, 50, the user selects a desired guide tip sleeve 30, 40, or 50, e.g., guide tip sleeve 40, and inserts upper edge 18 of eyecup 16 into the inner pocket 60 of guide tip sleeve 40 until guide tip sleeve 40 substantially encompasses eyecup 16 and is engaged thereabout via friction-fitting. The orientation of guide tip sleeve 40 when engaged about eyecup 16 is selected according to the eye to which makeup is to be applied. Further, due to the flexible nature of the guide tip sleeve 40, the guide tip sleeve 40, once engaged, conforms to the curvature of the eyecup 16.

Next, as seen in FIG. 6A, the user positions tool 10 adjacent an eye of the subject 100, e.g., themself or someone else. As illustrated, the left eye is the eye to which makeup is to be applied, and, accordingly, the guide tip sleeve 40 is oriented on eyecup 16 for the left eye. Tool 10, more specifically, is positioned such that the upper edge 42 of the guide tip sleeve 40 is in the desired location between the top of the eyelid 102 and beneath the brow bone adjacent the eye socket crease 104. Next, as seen in FIG. 6B, the user applies the upper edge 42 of the guide tip sleeve 40 to the crease 104 of the socket line so that it is set against the upper curvature of the subject's 100 eye. Then the user applies eye makeup 106 to the eyelid 102 following the curvature of arcuate upper edge 42 of the guide tip sleeve 40. Tool 10 may then be removed from the subject's 100 eye, as shown in FIG. 6C, leaving the applied makeup 106 in the desired location in the desired arc shape. To apply eye makeup to the other eye, e.g., the right eye, the user simply removes the guide tip sleeve 40 from the tool 10 and rotates it 180 degrees or applies a second mirror image guide tip sleeve to the eyecup 16, so that the guide tip 40 is on the appropriate side for applying makeup to the right eye. The user then repeats the steps above on the right eye.

Turning now to FIGS. 7A-7E, another tool provided in accordance with the present disclosure is generally identified by reference numeral 1000. Tool 1000 includes a handle 1200 and an eyecup 1600 extending from one end of the handle 1200. Handle 1200 is adapted to be grasped by a user and, to this end, may include any suitable ergonomic features facilitating comfortable grasping by the user. For example, to facilitate ergonomic grasping and manipulation of tool 1000, handle 1200 may define ring-shaped and annular ridges 1400 configured to inhibit sliding of a user's fingers off of handle 1200. Other suitable ergonomic features are also contemplated. Handle 1200 may be formed from a plastic material, silicone, rubber, or any other suitable material that is easily cleaned and visually pleasing. Handle 1200 may exhibit any color or variety of colors, patterns, graphics, or the like, and may be transparent or opaque.

Continuing with reference to FIGS. 7A-7E, handle 1200 has a free first end 1310 and a second end 1320 connected to eyecup 1600 via an offset 1500. Offset 1500 may be resiliently flexible, to at least some degree, to enable eyecup 1600 to be positioned against an eye without undue pressure. Eyecup 1600, similarly as with eyecup 16 (FIGS. 1 and 2), defines a curved configuration and includes an upper edge 1800 that may itself be used to apply eye makeup, and also includes opposing lateral side edges 1700. Opposing lateral side edges 1700 curve inwardly towards the front face of tool 1000 to define the curved configuration thereof.

Referring to FIGS. 8A-10D, in conjunction with FIGS. 7A-7E, in addition or as an alternative to directly using eyecup 1600 to facilitate application of makeup, eyecup 1600 may also serve as a connector to enable engagement of various different guide top panels or attachments 300, 400, 500 therewith to enable the guide top panels 300, 400, 500 to facilitate application of makeup. More specifically, eyecup 1600 is configured for partial insertion within recesses 310, 410, 510 defined within guide top panels 300, 400, 500, respectively, with opposing lateral side edges 1700 frictionally retained against the walls defining recesses 310, 410, 510 to thereby maintain guide top panels 300, 400, 500 in place on eyecup 1600.

Guide top panels 300, 400, 500 define different configurations and, more specifically, define differently contoured upper edges 320, 420, and 520, respectively, to allow makeup to be applied in various different arc shapes. As shown in FIGS. 8A-8E, guide top panel 300 defines an upper edge 320 having an almond-shaped contour. As shown in FIGS. 9A-9D, guide top panel 400 defines an upper edge 420 having a round-shaped contour. As shown in FIGS. 10A-10D, guide top panel 500 defines an upper edge 520 having a winged-shaped contour.

Instead of providing a reversible configuration as with guide top sleeves 30, 40, 50, detailed above (see FIGS. 1-6C), separate left and right guide top panels 300, 400, 500 (of mirror-image configuration) may be provided to enable application of makeup to the left and right eyes. Alternatively, guide top panels 300, 400, 500 may be reversible like guide top sleeves 30, 40, 50, detailed above (see FIGS. 1-6C). Guide top panels 300, 400, 500 may otherwise be formed similarly, function similarly, and be used similar to guide top sleeves 30, 40, 50, detailed above (see FIGS. 1-6C).

While particular embodiments of the present disclosure have been described above, it is not intended that the present disclosure be limited thereto, as it is intended that the present disclosure be as broad in scope as the prior art will allow and that the specification be read likewise. It will therefore be appreciated by those skilled in the art that other modifications could be made thereto without departing from the spirit and scope of the present disclosure.

What is claimed is:

1. A kit facilitating application of makeup, the kit comprising:

a tool including an elongated handle and an eyecup disposed at one end of the elongated handle; and a plurality of guide attachments, each guide attachment of the plurality of guide attachments including a solid continuous surface formed by a first lateral side, a second lateral side opposing the first lateral side, a bottom flat side extending from a bottom of the first lateral side to a bottom of the second lateral side, and a top contoured edge extending from a top of the first lateral side to a top of the second lateral side, the too contoured edge being opposite the bottom flat side, wherein the flat bottom side is configured to releasably engage the eyecup, the top contoured edge of a first guide attachment of the plurality of guide attachments is asymmetrical and has a round contour with an apex disposed proximate the second lateral side, such that only one continuous convex curvature is defined by an entire top contoured edge of the first guide attachment;

the top contoured edge of a second guide attachment of the plurality of guide attachments has an elongated contour with an apex positioned proximate a midpoint of the top contoured edge, such that only one continuous convex curvature is defined by an entire top contoured edge of the first guide attachment, wherein the first and second lateral sides of the second guide attachment diverge such that a length between the bottoms of the first and second lateral sides is less than a length between the tops of the first and second lateral sides; and the top contoured edge of a third guide attachment of the plurality of guide attachments has a winged contour defined by a single convex curvature proximate the first lateral side and a single concave curvature disposed proximate the second lateral side, wherein a point of inflection exits between the convex and concave curvatures, the point of inflection being closer to the second lateral side than to the first lateral side, wherein the first and second lateral sides of the third guide attachment diverge such that a length between the bottoms of the first and second lateral sides is less than a length between the tops of the first and second lateral sides; and during use, a user selects one of the plurality of guide attachments and places it over a user's upper eyelid to guide application of cosmetic material above the too contoured edge thereof.

2. The kit according to claim 1, wherein each guide attachment of the plurality of guide attachments is reversible.

3. The kit according to claim 2, wherein a first side of each guide attachment of the plurality of guide attachments is configured to facilitate application of makeup to one eye, and wherein a second side of each guide attachment of the plurality of guide attachments is configured to facilitate application of makeup to an opposite eye.

4. The kit according to claim 1, wherein each guide attachment of the plurality of guide attachments includes indicia indicating different sides thereof or indicia indicating a configuration of the top contoured edge thereof.

5. The kit according to claim 1, wherein each guide attachment of the plurality of guide attachments includes a first guide and a second guide that form a guide attachment pair, one guide in each guide attachment pair configured to facilitate application of makeup to a left eye, and the other guide in each guide attachment pair configured to facilitate application of makeup to a right eye, the first and second guides in each guide attachment pair defining mirror-image configurations of one another.

6. The kit according to claim 1, wherein each guide attachment of the plurality of guide attachments is a guide sleeve configured to receive the eyecup therein to releasably engage the guide sleeve about the eyecup.

7. The kit according to claim 1, wherein each guide attachment of the plurality of guide attachments is a guide panel defining a recess configured to at least partially receive the eyecup therein to releasably engage the guide panel on the eyecup.

8. The kit according to claim 1, wherein the eyecup includes a concave front surface configured to be positioned on the user's eye.

9. The kit according to claim 1, wherein the elongated handle includes at least one ergonomic feature to facilitate grasping the elongated handle, the at least one ergonomic feature having a width wider than a width of any portion of the elongated handle other than the at least one ergonomic feature.

* * * * *